United States Patent [19]

Yoshida et al.

[11] 4,058,883

[45] Nov. 22, 1977

[54] FABRICATION OF PANEL STRUCTURES HAVING THIN SKIN PLATE IN VEHICLES, WATER CRAFT, BUILDINGS, AND THE LIKE

[75] Inventors: Toshio Yoshida, Kobe; Kiyoshi Terai, Ashiya; Shigetomo Matsui; Tsuneo Kinoshita, both of Kobe; Akira Hoshi, Ashiya; Toru Tohmoto, Nishinomiya, all of Japan

[73] Assignee: Kawasaki Jukogyo Kabushiki Kaisha, Kobe, Japan

[21] Appl. No.: 651,282

[22] Filed: Jan. 22, 1976

[30] Foreign Application Priority Data

| | | |
|---|---|---|
| Jan. 27, 1975 | Japan | 50-11641 |
| Jan. 27, 1975 | Japan | 50-11642 |

[51] Int. Cl.[2] ..... B23P 11/02; B23K 28/02

[52] U.S. Cl. ..... 29/448; 52/223 R

[58] Field of Search ..... 29/447, 448, 449, 155 R; 52/48, 223 R

[56] References Cited

U.S. PATENT DOCUMENTS

| | | | |
|---|---|---|---|
| 2,110,752 | 3/1938 | Wright | 29/448 |
| 2,342,025 | 2/1944 | Walter | 29/447 |
| 2,441,858 | 5/1948 | Walter | 29/448 |
| 2,685,263 | 8/1954 | Barnes et al. | 29/448 X |
| 3,082,519 | 3/1963 | Ballentine et al. | 29/448 X |
| 3,322,190 | 5/1967 | Johnson | 29/448 X |

*Primary Examiner*—Charlie T. Moon

[57] ABSTRACT

A panel structure is fabricated by stretching a skin plate with a tensile stress below the elastic limit stress thereof, securing this plate onto a framework with the plate under a constraining tensile stress and with portions thereof to which the constraining stress is not being fully applied being heated thereby to cause thermal expansion thereof, removing the constraining stress, and permitting the plate to cool and thereby to undergo thermal contraction and deformation, thereby producing tensile residual stress within the plate, whereby occurrence of welding deformations in the plate on the finished panel is prevented. Depending on the necessity, the skin plate may be prestretched with a stress exceeding the yield point thereof before the above described panel fabrication.

8 Claims, 10 Drawing Figures

8
8a
8b
8b1
9a
9b
10a
10b
11
11a
12
13a
13b
14
15a
15b
16
1
2

FABRICATION OF PANEL STRUCTURES HAVING THIN SKIN PLATE IN VEHICLES, WATER CRAFT, BUILDINGS, AND THE LIKE

BACKGROUND OF THE INVENTION

This invention relates generally to panel structures of building materials such as roof paneling and side paneling members in sheet and thin-plate structures of railway rolling stock, ships, buildings, and other structures. More particularly, the invention relates to a method of fabricating panel structures of the above stated character and of the type comprising a skeletal framework and an outside or skin plate secured to the framework in a manner to prevent welding deformations in the skin plate.

In recent years, there has been a great demand for reductions in structural weights, particularly in railway rolling stock, and, in accordance with this demand, there has been progress in the reduction of wall thicknesses of the structural members (panels) of vehicular structures. In the case of steel materials, in general, the thin wall thicknesses of skin plates are of the order of 1.2 to 1.6 mm., while those of framework members are of the order of 2.3 to 4.5 mm. As a consequence of this trend toward reduced thicknesses, the occurrence of deformations at the time of assembly of the constituent members (e.g., roof paneling members and side paneling members) in thin plate structures as mentioned above has been unavoidable.

Of the kinds of deformations which thus occur, approximately 50 percent is a "sagging" of skin plates, which is a buckling form of deformation peculiar to thin plate structures, while approximately 40 percent is an "irregular passage (bending)". These two kinds of deformation make up 90 percent of all deformations. The "sagging" of skin plates includes local strains due to rolling during the production of these plates and strains due to welding. For this reason, when a skin plate of the character referred to above is secured to a grid-like framework by a process such as welding, various kinds of deformations in the form of concavities and convexities are produced in the individual rectangular bays or unit grid frames of the skin plate.

Heretofore, these convex-concave deformations have been removed by a deformation removal process which comprises local heating (for example, point heating or line heating) of each bay after fabrication of a panel and thereafter rapidly cooling the same. The work in man-hours required for this deformation removing work has been found to be a tremendous 20 to 25 percent of the work for assembling a vehicle body and thereby entails a great amount of labor and other cost.

Moreover, in the case of stainless steel plate materials, deformation removal cannot be carried out because heated parts become colored, whereby the panel looses its commercial value. For this reason, stainless steel plates are used in the form of corrugated skin plates although this form is expensive and looses some aesthetic value. Furthermore, in the case of aluminum materials, since their thermal conductivity is good, the efficiency of the work of deformation removal by point heating is poor, and deformation cannot be removed in some cases. Accordingly in the present state of the art, complicated work procedures using such means as auxiliary cooling plates are resorted to in producing aluminum material panels.

It has heretofore been considered that, as mentioned above, the occurrence of welding deformations in thin plate structures is unavoidable, and in all previous methods, suitable deformation removal work was carried out after the deformations developed.

SUMMARY OF THE INVENTION

In view of the above described circumstances, it is a general object of this invention to provide a method of fabricating panel structures without occurrence of deformations by subjecting thin plates (outer or skin plates) to an appropriate deformation preventing processing prior to and during asssmbly thereof on a skeletal framework. We have found that the above stated and other objects of this invention can be achieved by processing a skin plate of a panel structure prior to and during attachment thereof to a skeletal framework in a manner to impart tensile residual stress to the skin plate in the finished panel structure, and that this tensile residual stress can be imparted by subjecting the skin plate to a physical condition such that it assumes a state wherein it is elastically expanded in its geometric surface relative to its normal state and then, with the plate in this expanded state, securing it to the framework.

According to this invention in one aspect thereof, there is provided a stretching method of fabricating a panel structure of the above stated kind in which the above mentioned tensile residual stress is imparted to the skin plate by applying an appropriate tensile constraining stress to only the skin plate prior to securing thereof to the framework, securing the skin plate to the framework while the skin plate is held in a state under an elastic strain due to a tensile stress below its elastic limit applied thereto, and then removing the tensile constraining stress.

According to this invention in another aspect thereof, there is provided a heating method fabricating a panel structure of the above stated kind in which the above mentioned tensile residual stress is imparted to the skin plate by heating only the skin plate to an appropriate temperature prior to the securing thereby to cause the plate to undergo thermal expansion, securing the plate in this thermally expanded state to the framework at room temperature, and stopping the heating of the skin plate thereby to permit it to cool to room temperature.

According to this invention in still another aspect thereof, there is provided a stretching and heating method of fabricating a panel structure of the above stated kind in which the above mentioned tensile residual stress is imparted to the skin plate by a combination of the above described two methods thereby to obtain a superimposed effect from the tensile stretching and heating.

According to this invention in a further aspect thereof, there is provided a method of fabricating a panel structure of the above stated kind which comprises any of the above stated three methods and a preceding step of subjecting the skin plate to an overstretch thereby to impart thereto a stress exceeding the yield point of the plate material.

The nature, principle, utility, and further features of this invention will be apparent from the following detailed description with respect to preferred embodiments of the invention when read in conjunction with the accompanying drawings, briefly described below, throughout which like parts are designated by like reference numerals and characters.

DETAILED DESCRIPTION OF THE INVENTION

Figure 1:
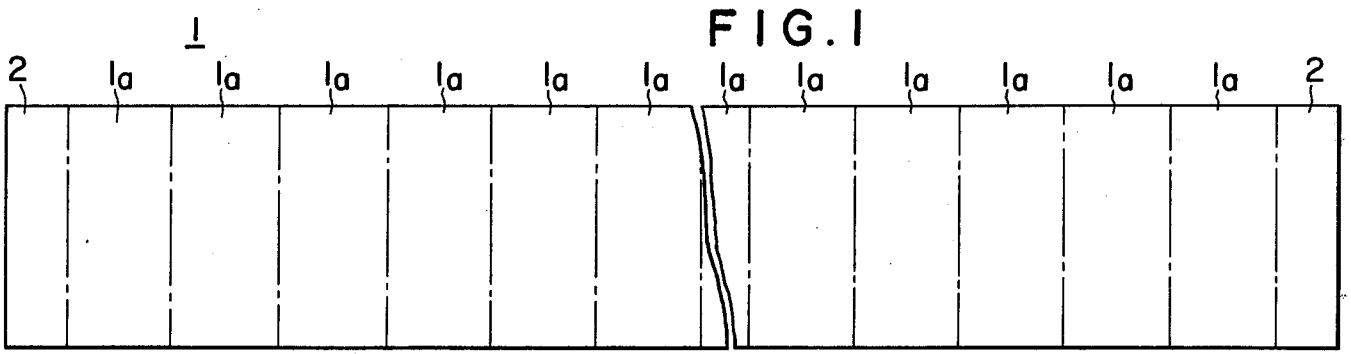
FIG. 1 is a foreshortened plan view of a skin plate for the roof of a railway vehicle.
Figure 2:
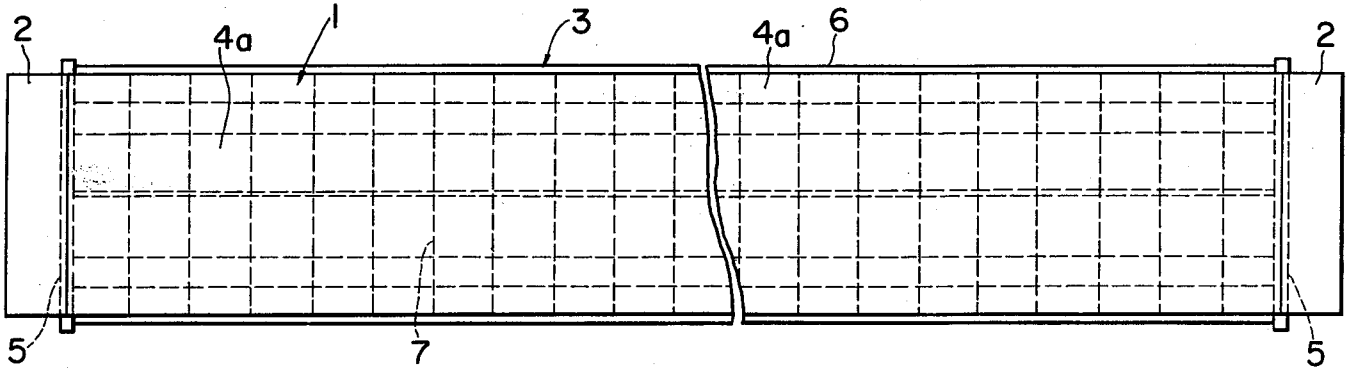
FIG. 2 is a foreshortened plan view of a panel structure fabricated with the skin plate shown in FIG. 1 for the roof.

The following example of the invention is that of its application to the fabrication of a panel structure for the roof of a railway vehicle. An outside sheet or skin plate 1 of the shape shown in FIG. 1 is formed by joining by welding side-by-side a large number of reactangular, thin plate material elements 1*a* of a specified character and is provided at its two ends with chucking parts, 2, 2 to be subsequently cut away. A roofing panel structure 4 fabricated by securing this skin plate 1 onto a framework 3 by welding is shown in FIG. 2. The framework 3 is formed by assembling end arches 5, 5, cant rails 6, 6, and transverse member 7, . . . in the form of a grid.

The manner in which this roofing panel structure 4 is fabricated in accordance with this invention by the stretching method thereof is as follows.

1. The skin plate 1, in a state wherein a constraining tension is being applied thereto by a stretching apparatus is secured to the framework 3 as by welding.

2. Upon completion of the above step 1), the above mentioned constraining tension is removed, whereupon the panel structure fabrication is completed.

Figures 3, 4, 5:
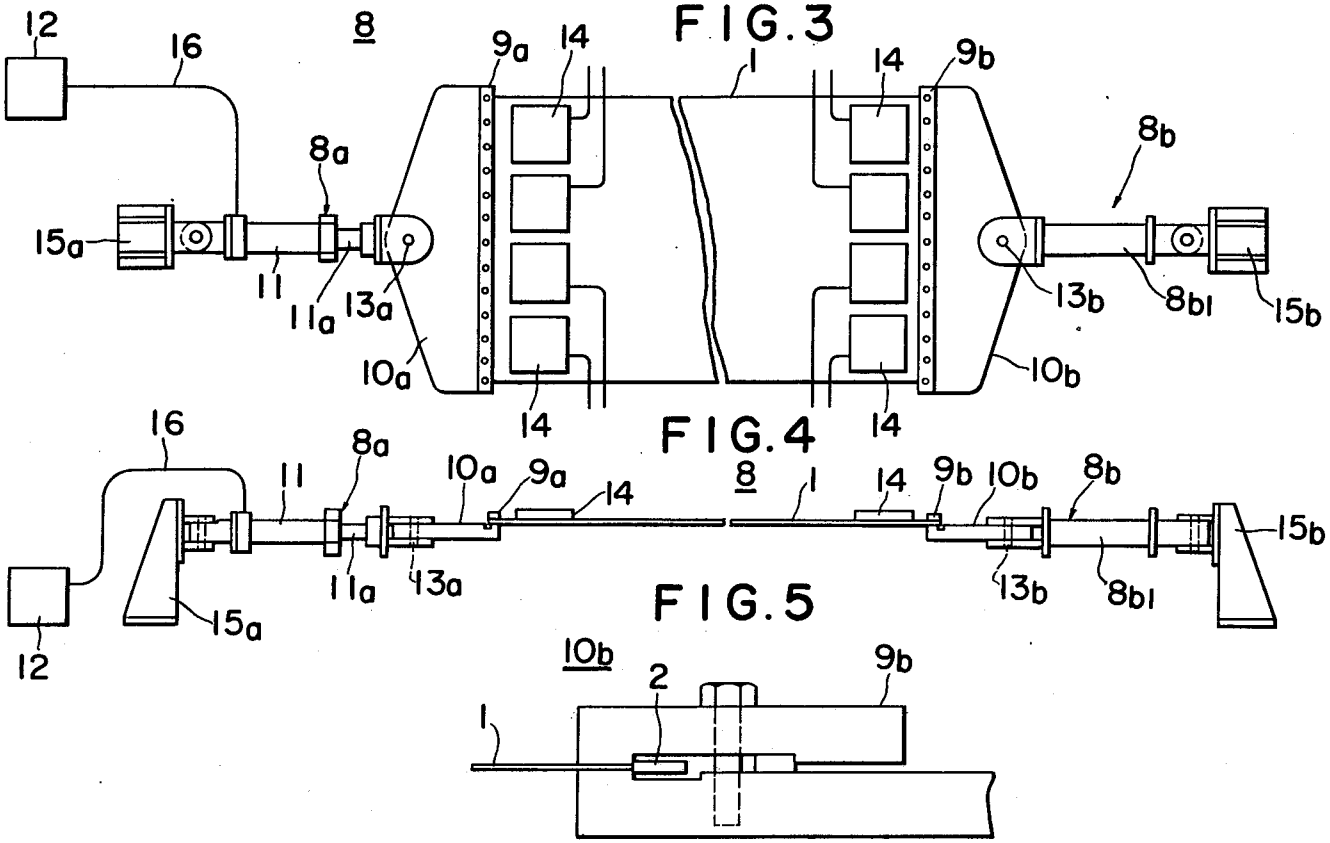
FIG. 3 is a diagrammatic, foreshortened plan view showing an apparatus suitable for use in the method of the invention.
FIG. 4 is a side elevation of the apparatus illustrated in FIG. 3.
FIG. 5 is an enlarged side elevation of an essential part of the apparatus shown in FIGS. 3 and 4.

One example of a stretching apparatus 8 for exerting tension forces on the skin plate 1 during the fabrication of the panel structure 4, as illustrated in FIGS. 3, 4, and 5, comprises a moving, load-applying (active) part 8*a* and a stationary, load-applying (reactive) part 8*b*. These parts 8*a* and 8*b* are respectively provided with chucking bases or heads 10*a* and 10*b* having mutually facing chucks 9*a* and 9*b* for gripping the end portions of the skin plate 1. A central pivot point of the chucking base 10*a*, at a part thereof remote from the chuck 9*a*, is coupled by a pin joint 13*a* to the outer end of a piston rod 11*a* of a hydraulic cylinder 11 which is pin connected at its head end to an anchoring structure 15*a* and is operable by a hydraulic pressure system 12 connected thereto through piping 16. A central pivot point of the chucking base 10*b*, at a part thereof remote from the chuck 9*b*, is coupled by a pin joint 13*b* to one end of a rod $8b_1$ which is pin connected at its other end to an anchoring structure 15*b* fixed in space relative to the anchoring structure 15*a*. The above described pin joints, particularly the pin joints 13*a* and 13*b* are provided to assure uniform application of tension force to the skin plate 1. Heaters 14, 14, . . . . shown in FIGS. 3 and 4 are not used in the instant stretching method but are used in the stretching and heating described hereinafter.

The effectiveness and utility of this invention is preventing the occurrence of welding deformations in the fabrication of panel structures will now be described with respect to the roofing panel structure 4 of the above description.

As a result of the application of the constraining tensile force in the first step 1), the skin plate 1 undergoes elastic elongation deformation. Then, in the second step 2), the skin plate 1 undergoes an elastic contraction deformation due to the removal of the constraining tensile force. This deformation of the skin plate 1 is constrained by the framework 3, whereby a tensile residual stress remain in the plate 1.

Figure 6:
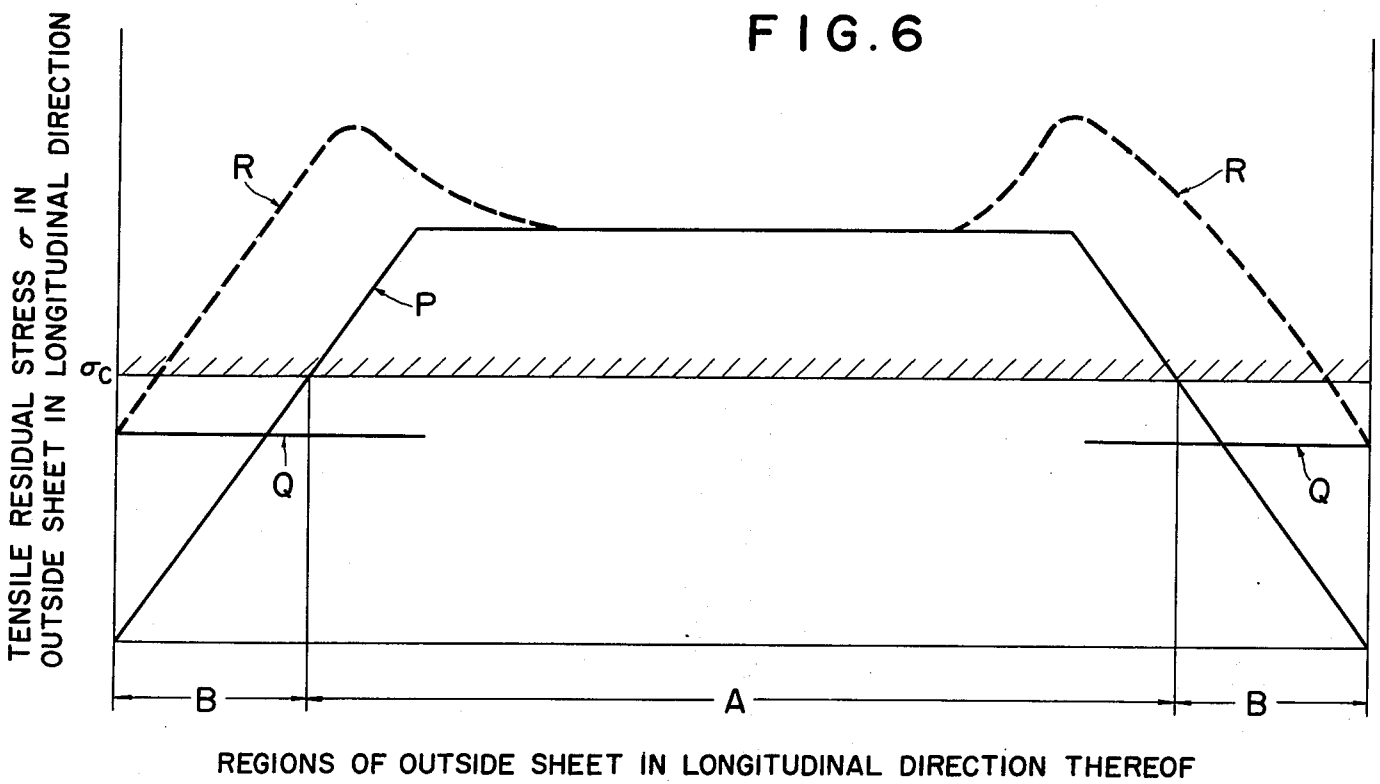
FIG. 6 is a graphical representation indicating an example of distribution of residual tensile stress in a skin plate in the longitudinal direction thereof.

The distribution of this tensile residual stress in the longitudinal direction of the skin plate 1 is indicated in FIG. 6. First, a tensile residual stress distribution (represented by line P in FIG. 6) of trapezoidal shape is produced in the skin plate by the application of the constraining tensile force after the removal of this load. In a distribution region A (middle part of the plate 1) corresponding to a part of the line P where the tensile residual stress is higher than a critical stress $\sigma_c$ below which deformation occurs, no deformation occurs. The level of the critical stress $\sigma_c$ is slightly lower than that of zero stress, so that the stress $\sigma_c$ is actually a compression stress. It is to be noted that even under compression stress, no deformation of the skin plate occurs if the compression stress is at or above the critical stress $\sigma_c$. However, in practical application of the principle of the invention, the skin plate is treated to leave only the tensile residual stress therein. On the other hand, in distribution regions B (and portions of the plate 1) corresponding to parts of the line where the tensile residual stress is lower than the critical stress $\sigma_c$ because the constraining stress is not fully applied, deformation can occur.

Thus, in accordance with the method of this invention, deformations such as welding deformations and local deformations existing in the skin plate can be completely prevented by producing a uniform tensile residual stress over the entire skin plate. Therefore, there is almost no occurrence of deformations in the panel structure, thus obtained, and deformation removal work as heretofore practiced is unnecessary.

Figure 7:
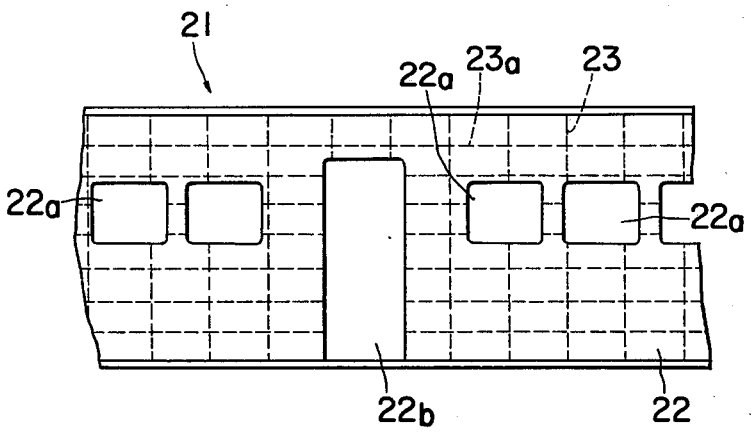
FIG. 7 is a fragmentary planar view of a panel structure for a side wall of a vehicle body.

In another embodiment of this invention, the heating method thereof is applied to the fabrication of an outer wall panel structure of a side wall of railway vehicle body as shown in FIG. 7. In its completed state, this panel structure 21 comprises, essentially, a framework 23 of grid shape and a side skin plate 22 secured to this framework 23 by welding. The skin plate 22 is formed by joining by welding edge-to-edge a large number of rectangular, thin plate elements and is provided with openings 22*a* and 22*b* respectively for windows and doorways. The framework 23 is formed by assembling a large number of angle frame members 23*a* in a grid state. In the completed panel 21, the skin plate 22 is divided into several rectangular bays or unit grid frames 24 by the grid shaped framework 23.

Figure 8:
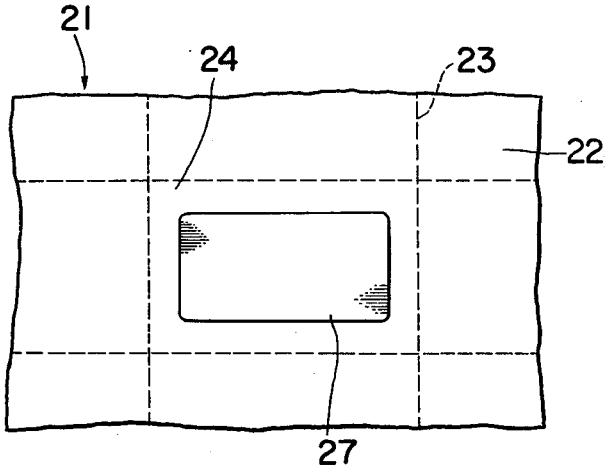
FIG. 8 is a plan view showing the manner in which a panel structure is fabricated by the heating method of the invention.
Figure 9:
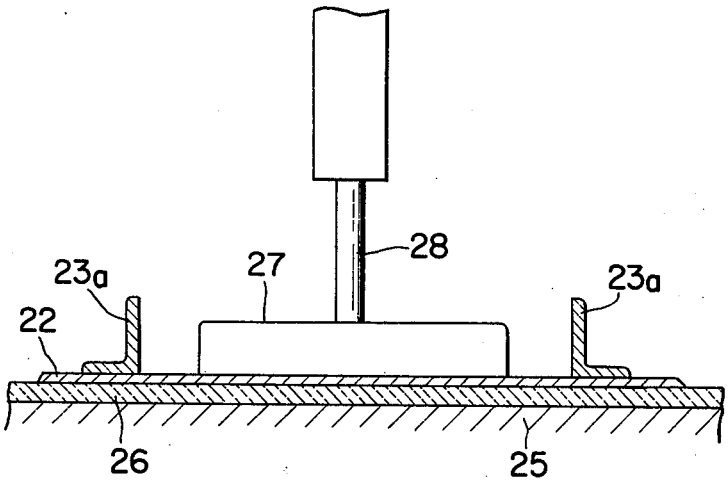
FIG. 9 is an elevation, with some parts shown in vertical section, showing the panel structure shown in FIG. 8 and essential apparatus parts for the fabrication.

Next, the sequential procedure according to this invention of fabricating the panel structure 21 for the vehicle side wall will now be described with reference to FIGS. 8 and 9.

1. On a surface table or surface plate 25, a thermal insulation matrial 26 such as asbestos in plate form is laid.
2. A side skin plate 22 is laid on the insulation material 26.
3. A heater 27 (or heated iron plate) which has been preheated beforehand to a temperature of the order of 150° C is placed on the skin plate 22 at part thereof corresponding to the center of a bay 24 and is operated in a state wherein it is pressed downward against the skin plate 22 by a press 28 to heat the plate 22 to a temperature of approximately 100° to 150° C. The above treating conditions somewhat vary depending on the nature of the panel structure, the material of the skin plate and the welding conditions.
4. With the skin plate 22 in a thermally expanded state resulting from the above heating, a framework 23 at room temperature is attached temporarily thereon and then welded thereto.
5. After welding, the heater 27 is immediately removed, and the parts thus welded are cooled as they are to room temperature, whereupon the panel structure fabrication is completed.

Figure 10:
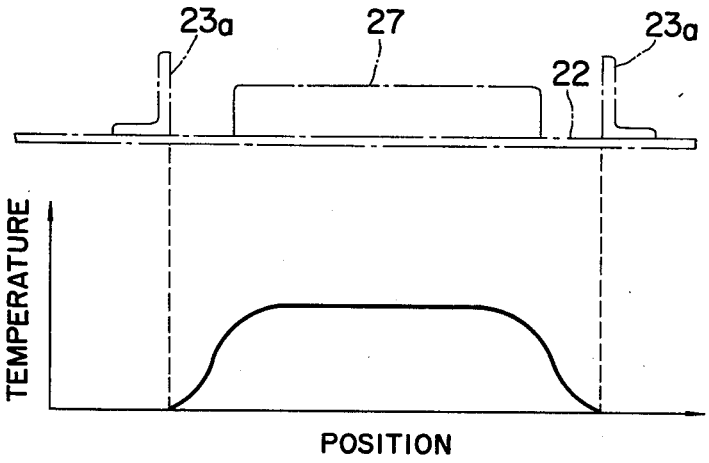
FIG. 10 is a graph indicating the temperature rise distribution in the skin plate due to a heater immediately prior to the securing of the skin plate to the framework.

The above described fabrication procedure according to this invention is highly effective in preventing deformation in the following manner. The skin plate 22 (considered in one bay 24) undergoes thermal expansion, exhibiting a temperature rise distribution as indicated in FIG. 10, as a result of the preheating imparted thereto by the heater 27. By securing the skin plate 22 in this thermally expanded state to the framework 23 and then removing the heater 27, the plate 22 is cooled. The thermal contraction and deformation of the plate 22 which would otherwise accompany this cooling is constrained by the framework 23, and, consequently, a tensile stress remains in the plate 22.

This tensile residual stress prevents strains which would otherwise arise as a result of welding, whereby concave and convex deformations do not develop in the bay 24. Accordingly, there is no necessity for the work of removing deformations after the panel structure fabrication. Furthermore, the pressing action on the plate 22 by the press 28 during the heating by the heater 27 prevents concave and convex deformation of the plate due to preheating.

Thus, in accordance with this invention, there is provided a panel structure fabrication method which comprises applying preheating to a skin plate to cause it to undergo thermal expansion and securing the plate in this thermally expanded state to a framework, the thermal contraction and deformation of the plate occuring at the time of cooling producing tensile residual stress in the plate, whereby deformation of the plate is prevented. As a result, the panel structure thus fabricated has almost no concave and convex deformation, whereby deformation removal work after fabrication, as was required heretofore, becomes unnecessary. Accordingly, the possibility of deterioration of the product quality, development of defects, and other deleterious occurrences is greatly reduced. In the production process, also, reduction in work by skilled labor and saving in power consumption are attained. Moreover, a great reduction in direct labor manhours is attainable. Thus, a great reduction of production cost can be achieved.

This panel structure fabrication method wherein preheating is utilized is particularly effective in the fabrication of panel structures for side walls having openings in the skin plates which cannot be subjected to stretching or in the fabrication of a panel structure with a skin plate having parts wherein a complete tensile constraining stress distribution cannot be obtained by constraining tensile force. Furthermore, the instant method of this invention is effective in preventing plate deformation in panel structures of aluminum materials, deformations which could not be easily removed by the point heating method because of the high thermal conductivity of these materials. Still another advantageous feature of this method is that, since the heating temperature is usually less than 150° C the method can be applied also to stainless steel materials in fabricating panel structures without coloring skin plates.

Still another embodiment of the invention will now be described with respect to an application of the stretching and heating method thereof to the fabrication of a panel structure for the roof of a railway vehicle. A skin plate 1 of the shape shown in FIG. 1 is formed by joining by welding side-by-side a large number of rectangular, thin plate material elements **1*a* of a specified character and is provided at its two ends with chucking parts 2, 2 to be subsequently cut away. A roofing panel structure 4 fabricated by securing this skin plate 1 onto a framework 3 by welding is shown in FIG. 2. The framework 3 is formed by assembling end arches 5, 5, cant rails 6, 6, and transverse member 7**, . . . . in the form of a grid.

The manner in which this roofing panel structure 4 is fabricated in accordance with this invention by the stretching and heating method thereof is as follows.

1. The skin plate 1, in a state wherein a constraining tension is being applied thereto by the stretching apparatus 8, and portions of the plate 1 such as the end parts thereof to which the constraining tension cannot be amply applied are being caused to undergo thermal expansion by being preheated by heaters 14, is secured to the framework 3.

2. Upon completion of the above step 1), the above mentioned constraining tension is removed, and the heaters 14 are disconnected thereby to cause the skin plate 1 to undergo thermal contraction and deformation accompanying its cooling, whereupon the panel structure fabrication is completed.

One example of a stretching apparatus 8 for exerting tension forces on the skin plate 1 during the fabrication of the panel structure 4, as illustrated in FIGS. 3, 4, and 5, comprises a moving, load-applying (active) part **8*a* and a stationary, load-applying (reactive) part 8*b*. These parts 8*a* and 8*b* are respectively provided with chucking bases or heads 10*a* and 10*b* having mutually facing chucks 9*a* and 9*b* for gripping the end portions of the skin plate 1. A central pivot point of the chucking base 10*a*, at a part thereof remote from the chuck 9*a*, is coupled by a pin joint 13*a* to the outer end of a piston rod 11*a* of a hydraulic cylinder 11 which is pin connected at its head end to an anchoring structure 15*a* and is operable by a hydraulic pressure system 12 connected thereto through piping 16. A central pivot point of the chucking base 10*b*, at a part thereof remote from the chuck 9*b*, is coupled by a pin joint 13*b* to one end of a rod 8*b*$_1$ which is pin connected at its other end to an anchoring structure 15b in space relative to the anchoring structure 15a. The above described pin joints, particularly the pin joints 13a and 13b are provided to assure uniform application of tension force to the skin plate 1**.

In addition, as shown in FIGS. 3 and 4, heaters 14, 14, . . . . (or hot plates) are installed by contact attachment to the surface of the skin plate 1 gripped by the chucks 9a and 9b of the stretching apparatus 8 at parts of the plate near its ends. These end parts of the plate are thus heated to a temperature of the order of 100° C, for example.

The effectiveness and utility of this invention in preventing the occurence of deformations in the fabrication of panel structures will now be described with respect to the roofing panel structure 4 of the above description.

First, in the aforedescribed first process step 1), the deformations due to welding arising during the production of the skin plate 1 and the local strains thereof due to rolling are removed. Next, as a result of the application of the constraining tensile force in the first step (1), the skin plate 1 undergoes elastic elongation deformation. At the same time, the end portions of the skin plate 1, to which the constraining tensile force cannot be amply applied undergo thermal expansion due to the preheating. Then, in the second step (2), the skin plate 1 undergoes an elastic contraction deformation due to the removal of the constraining tensile force and a thermal contraction deformation accompanying the cooling thereof after disconnecting and removal of the heaters 14. These deformations of the skin plate 1 are constrained by the framework 3, whereby a tensile residual stress remains in the plate 1.

The distribution of this tensile residual stress in the longitudinal direction of the skin plate 1 is indicated in FIG. 6. First, a tensile residual stress distribution (represented by line P in FIG. 6) of trapezoidal shape is produced in the skin plate by the application of the constraining tensile force after the removal of this load. In a distribution region A (middle part of the plate 1) corresponding to a part of the line P where the tensile residual stress is higher than a critical stress $\sigma_c$ below which deformation occurs, no deformation occurs. On the other hand, in distribution regions B (end portions of the plate 1) corresponding to parts of the line where the tensile residual stress is lower than the critical stress $\sigma_c$ because the constraining stress is not fully applied, deformation can occur. In these deformation occuring regions B (i.e., end portions of the plate 1), a distribution of contraction deformation stress (tensile residual stress) as indicated by line Q in FIG. 6 is further produced at the time of cooling as a result of the previous preheating.

As a consequence of the superimposition of these lines P and Q, that is, the combined effect of the constraining tensile force and of the preheating, a tensile residual stress as indicated by curve R in FIG. 6 is produced in the skin plate 1, whereby there is almost no deformation occuring region in the plate 1. Accordingly, there is almost no occurrence of concave-convex deformations in the rectangular bays 4a, 4a, . . . . defined by the framework 3 in the skin plate 1 in the fabricated roofing panel structure 4, whereby there is no necessity of the work of deformation removal after fabrication of the panel structure.

We have found that, in the case of a roof structure of a vehicle, particularly when SPA-H (*JAPANESE INDUSTRIAL STANDARDS*) of 1.2 mm thickness is used as the skin plate, deformations in the skin plate can be almost completely prevented by a applying thereto a tensile constraining stress of the order of 25 kg/mm$^2$ or more in the above described stretching method, by heating the skin plate to a temperature of from 100° C to 150° C in the above described heating method, and by applying a tensile constraining stress of the order of 15 kg/mm$^2$ to the plate and heating the same at a temperature of the order of 50° C in the above described stretching and heating method.

While the stretching method and the stretching and heating method in accordance with the invention have been described above with respect to stretching in a single direction, the invention is not restricted to undirectional stretching, it being possible to stretch a skin plate in a plurality of mutually nonparallel directions.

Furthermore, while certain embodiments of the invention have been described with respect to cases where the skin plate is of substantially planar form, it will be apparent that the invention is also applicable to the fabrication of panel structures with skin plates which are nonplanar and secured to correspondingly shaped frame-works. Such skin plates may have a single curvature or a double curvature.

Whenever necessary in the practice of this invention, the skin plate 1 may be overstretched with a tensile stress exceeding the tensile yield point thereof thereby to remove strains due to rolling of the sheet stock and preassembly thereof by welding together sheet plate elements edge-to-edge, this overstretching step being carried out prior to any of the above described three methods of panel structure fabrication.

Thus, in accordance with the method of this invention, deformations such as welding deformations and local deformations already existing in the skin plate can be removed by over-stretching of the skin plate, and, in addition, occurrence of deformations can be completely prevented by producing a uniform tensile residual stress over the entire skin plate as a result of the superimposed effect of the constraining tensile force and/or preheating applied to the skin plate. Therefore, there is almost no occurrence of deformations in the panel structure thus obtained, and deformation removal work as heretofore practiced is unnecessary.

For this reason the possibility of developement of material deterioration, defects, and other deleterious features of product quality is greatly reduced. Furthermore, in production, the need for skilled labor is reduced, and power consumption is lessened. Production cost can be further reduced greatly since direct labor is remarkably decreased. Thus, this invention has high utility in the production of thin-plate structures used in the vehicle manufacturing, shipbuilding, architectural, and other fields.

We claim:

1. A method of fabricating a panel structure of the type having a skeletal framework and a skin plate secured to the framework comprising the steps of:

subjecting the skin plate to tensile stretching within the geometric surface thereof to produce a constraining tensile stress in the skin plate not exceeding the tensile elastic limit of the skin plate, the tensile stress being adequately applicable to at least a portion thereof;

concurrently heating the skin plate locally at portions thereof to which the constraining tension cannot be adequately applied to a temperature above room temperature to induce thermal expansion of the skin plate within its geometric surface;

welding the stressed and locally heated skin plate to the framework;

simultaneously maintaining the stressed and heated condition of the skin plate; and thereafter releasing the skin plate from the tensile stretching and from the heating so as to leave a tensile residual stress in the skin plate to prevent undesirable deformation thereof in the fabricated panel structure.

2. A method of fabricating a panel structure as set forth in claim 1 in which the heated portions are end parts of the skin plate.

3. A method of fabricating a panel structure as set forth in claim 1 in which the temperature is of the order of 100° C.

4. A method of fabricating a panel structure as set forth in claim 1, further comprising the step of overstretching the skin plate to apply thereto a tensile stress exceeding the tensile yield point stress thereof, prior to the step of subjecting the skin plate to tensile stretching and heating.

5. A method of fabricating a panel structure of the type having a skeletal framework and a skin plate secured to the framework and having openings therein comprising the steps of:

subjecting the skin plate to a tensile stretching within the geometric surface thereof to produce a constraining tensile stress in the skin plate not exceeding the tensile elastic limit of the skin plate, a complete tensile constraining distribution being obtainable in at least a portion thereof, concurrently heating the skin plate at portions thereof in which the complete tensile constraining stress distribution is not obtainable by the constraining tensile force, to a temperature above room temperature to induce thermal expansion of the skin plate within its geometric surface;

welding the stressed and locally heated skin plate to the framework;

simultaneously maintaining the stressed and heated condition; and thereafter releasing the skin plate from the tensile stretching and heating so as to leave a tensile residual stress in the skin plate to prevent undesirable deformation thereof in the fabricated panel structure.

6. A method of fabricating a panel structure as set forth in claim 1 in which the heating is carried out by hot plates pressed against the surface of the skin plate.

7. A method of fabricating a panel structure as set forth in claim 1 in which the skin plate comprises a plurality of plate elements joined edge-to-edge.

8. A method of fabricating a panel structure as set forth in claim 1 in which the skin plate is a sheet of metal.

* * * * *